US007730618B2

(12) United States Patent
Darvaux-Hubert et al.

(10) Patent No.: US 7,730,618 B2
(45) Date of Patent: Jun. 8, 2010

(54) METHOD FOR WORKING OR FORMING METALS IN THE PRESENCE OF AQUEOUS LUBRICANTS BASED ON METHANESULFONIC ACID

(75) Inventors: Gilles Darvaux-Hubert, Franconville (FR); Fabrice Domingues Dos Santos, Lyons (FR); François Guillemet, Paris (FR)

(73) Assignee: Arkema France, Colombes (FR)

( * ) Notice: Subject to any disclaimer, the term of this patent is extended or adjusted under 35 U.S.C. 154(b) by 888 days.

(21) Appl. No.: 10/495,540

(22) PCT Filed: Nov. 8, 2002

(86) PCT No.: PCT/FR02/03847

§ 371 (c)(1),
(2), (4) Date: May 13, 2004

(87) PCT Pub. No.: WO03/042342

PCT Pub. Date: May 22, 2003

(65) Prior Publication Data

US 2005/0044912 A1 Mar. 3, 2005

(30) Foreign Application Priority Data

Nov. 15, 2001 (FR) ..... 01 14787

(51) Int. Cl.
*B23P 17/00* (2006.01)
*B21B 45/02* (2006.01)
*C10M 159/24* (2006.01)

(52) U.S. Cl. ..... 29/897; 72/42; 508/392; 508/390; 508/391

(58) Field of Classification Search ..... 72/42; 508/390, 391, 392; 29/426.1, 897, 898.1
See application file for complete search history.

(56) References Cited

U.S. PATENT DOCUMENTS 2,540,534 A * 2/1951 Kolfenbach et. al. ..... 508/413
2,841,554 A * 7/1958 Ambrose et al. ..... 508/390
3,388,062 A * 6/1968 Vaughn ..... 508/390
3,928,215 A * 12/1975 Dreher et al. ..... 508/175
4,036,764 A * 7/1977 Fischer et al. ..... 507/135
4,079,012 A * 3/1978 Bosniack ..... 508/409
4,181,624 A * 1/1980 Koch ..... 252/392
4,212,750 A * 7/1980 Gorman ..... 508/279
4,239,634 A * 12/1980 Marin et al. ..... 508/412
4,379,063 A 4/1983 Williams
4,505,830 A * 3/1985 Vinci ..... 508/186
4,560,488 A * 12/1985 Vinci ..... 508/336
4,606,833 A 8/1986 Schuettenberg et al.
4,620,855 A 11/1986 Higgius
4,659,488 A * 4/1987 Vinci ..... 508/324
4,670,172 A * 6/1987 Sproul et al. ..... 508/511
4,747,972 A * 5/1988 Holden et al. ..... 508/416
4,759,861 A * 7/1988 Ogura et al. ..... 508/390
4,778,614 A * 10/1988 Rawlinson et al. ..... 508/195
4,828,657 A * 5/1989 Fukuoka et al. ..... 205/254
4,880,552 A 11/1989 Guesnet et al.
4,923,887 A * 5/1990 Bauer et al. ..... 514/373
5,312,974 A * 5/1994 Wuest et al. ..... 562/120
5,322,631 A * 6/1994 Fuchigami et al. ..... 508/385
5,352,373 A * 10/1994 Goto ..... 508/400
5,367,903 A * 11/1994 Keller ..... 72/42
5,449,470 A * 9/1995 Cahoon et al. ..... 508/460
5,599,780 A * 2/1997 Koyama et al. ..... 508/391
5,733,853 A * 3/1998 Bardasz et al. ..... 508/485
5,908,816 A * 6/1999 Kobessho et al. ..... 508/391
6,040,281 A * 3/2000 Bereuter et al. ..... 508/508
6,190,574 B1 * 2/2001 Nakagawa et al. ..... 252/68
6,204,228 B1 3/2001 MacNeil et al.
6,355,604 B2 * 3/2002 Guillemet ..... 508/431
6,376,433 B1 * 4/2002 Connor ..... 508/163
6,410,491 B1 * 6/2002 Harrison et al. ..... 508/391
6,436,882 B1 * 8/2002 Rizvi ..... 508/390
6,562,766 B1 * 5/2003 Koyama et al. ..... 508/372
6,602,833 B1 * 8/2003 Skold ..... 508/423
6,706,670 B2 * 3/2004 Kalota et al. ..... 508/185
6,764,982 B2 * 7/2004 Bardasz et al. ..... 508/293
6,787,192 B2 * 9/2004 Fukumura et al. ..... 427/402
6,809,069 B2 * 10/2004 Deshimaru et al. ..... 508/398
6,828,286 B2 * 12/2004 Komiya et al. ..... 508/192
7,008,909 B2 * 3/2006 Burgo et al. ..... 508/463
7,018,959 B2 * 3/2006 McCullough et al. ..... 508/250
7,285,516 B2 * 10/2007 Carrick et al. ..... 508/192
7,332,461 B2 * 2/2008 Eastwood ..... 508/463

(Continued)

FOREIGN PATENT DOCUMENTS

EP 318736 A1 * 6/1989

(Continued)

OTHER PUBLICATIONS

English language machne translation of EP 0 915 183.*

*Primary Examiner*—Essama Omgba
(74) *Attorney, Agent, or Firm*—Steven D. Boyd

(57) ABSTRACT

A method for working or forming metals which consists in usings an aqueous lubricant containing as water-soluble extreme pressure additive, methanesulphonic acid or water-soluble methanesulphonic acid salt. The water-soluble methane sulphonic acid salt is an alkali or alkaline-earth, ammonium, alkanol amine or ethoxylated fatty amine salt. The inventive aqueous lubricants have good extreme pressure properties and good properties with respect to corrosion.

6 Claims, No Drawings

U.S. PATENT DOCUMENTS

| | | | | |
|---|---|---|---|---|
| 2002/0106978 | A1* | 8/2002 | Michaud et al. | 451/48 |
| 2003/0130142 | A1* | 7/2003 | Nguyen | 508/494 |
| 2003/0159938 | A1* | 8/2003 | Hradil | 205/118 |
| 2003/0220206 | A1* | 11/2003 | Komiya et al. | 508/192 |
| 2004/0149587 | A1* | 8/2004 | Hradil | 205/252 |
| 2005/0164610 | A1* | 7/2005 | Michaud et al. | 451/47 |
| 2005/0288193 | A1* | 12/2005 | Fujimaki et al. | 508/371 |
| 2006/0111252 | A1* | 5/2006 | Costello et al. | 508/390 |
| 2006/0113195 | A1* | 6/2006 | Hradil et al. | 205/302 |
| 2006/0156774 | A1* | 7/2006 | Inoue | 72/42 |
| 2006/0183649 | A1* | 8/2006 | Costello et al. | 508/390 |
| 2006/0223719 | A1* | 10/2006 | Riff et al. | 508/390 |
| 2007/0004600 | A1* | 1/2007 | Stoneman et al. | 508/390 |

FOREIGN PATENT DOCUMENTS

| | | | | |
|---|---|---|---|---|
| EP | 915183 | | | 11/2003 |
| JP | 60228541 | A | * | 11/1985 |
| JP | 63-265997 | | | 11/1988 |
| JP | 10-110181 | | | 4/1998 |
| SU | 1335562 | A1 | * | 9/1987 |
| WO | WO 03/042342 | A2 | * | 5/2003 |

* cited by examiner

METHOD FOR WORKING OR FORMING METALS IN THE PRESENCE OF AQUEOUS LUBRICANTS BASED ON METHANESULFONIC ACID

FIELD OF THE INVENTION

The present invention relates to the field of lubricants and more particularly to that of aqueous lubricants containing water-soluble extreme pressure additives, and which are used for working or forming metals.

BACKGROUND

Metal working or forming operations require the use of a lubricant in order to reduce the forces between the part to be worked and the tool, to remove the chips and fragments, to cool the part or the plate worked, and to control its surface texture. Oil-based lubricants have conventionally been used. These are whole oils or emulsions to which lubricity promoters, antiwear (AW) and/or extreme pressure (EP) additives may have been added. EP additives are generally compounds containing sulfur. At the high temperatures prevailing at the contact between the metal parts during metal working operations, the sulfur compounds decompose. A layer of iron sulfide is formed on the surface of the parts, hindering the processes of welding and adhesion.

Whole oils have excellent lubricating properties, but when production rates are high, the removal of the heat generated requires the use of emulsions. However, the use of emulsions also tends to be limited because, over time, they deteriorate and give off foul odors. This is why the use of aqueous fluids is steadily spreading. These are either synthetic fluids, which are aqueous solutions based on water-soluble additives, or semisynthetic fluids which are oil-in-water microemulsions containing a large quantity of emulsifiers. However, while the aqueous fluids effectively remove the heat and display improved resistance to bacterial proliferation, they are often limited to metal working operations in which the friction and wear conditions are not too severe. This is because EP additives have been developed specifically for oils, so that very few of these additives are water-soluble and therefore suitable for aqueous fluids.

While numerous oil-soluble EP additives are available, the number of water-soluble EP additives is much smaller. In Lub. Eng. 1977, 3(6), 291-298, R. W. Mould et al. describe the EP properties of a number of water-soluble sulfur-bearing additives, such as sodium salts of thiosalicylic, 2-mercaptopropionic, 2,2'-dithiodibenzoic, 2,2'-dithiodipropionic and dithiodiglycolic acids. Similarly, the use of water-soluble salts of 3,3'-dithiodipropionic acid has been the subject of U.S. Pat. No. 4,880,552 and JP 63 265 997. In U.S. Pat. No. 4,606,833, dithiodiglycol is used in combination with a derivative of polyoxyalkylene glycol to improve the extreme pressure properties of aqueous lubricants. The use of derivatives of aminosulfonic acids as additives in aqueous lubricating systems has been the subject of patent application WO 8602941. More recently, in Japanese patent application JP 10 110 181, the water-soluble salts of 3,3'-dithiodipropionic acid were combined with alkyl thioacids in aqueous drawing and stamping lubricants.

However, these products are not sufficiently stable in water. They promote bacterial proliferation and liberate hydrogen sulfide, causing the aqueous fluids to emit a strong odor. Their formulation thus requires the use of a large quantity of bactericides, which is incompatible with the quantities usually permitted in aqueous lubricants. Furthermore, some of these extreme pressure additives are incompatible with most of the other additives routinely used in synthetic and semisynthetic formulations.

Recently, lubricant compositions containing salts of sulfamic acid amines with extreme pressure effect have been the subject of patent application WO 00/44848. However, sulfamic acid is highly corrosive. Moreover, its low solubility precludes the production of liquid concentrates that are easy to use in the formulations. Furthermore, to limit the environmental impact of the lubricant formulations used in the field of metal working and forming, it is particularly important to employ readily biodegradable additives.

SUMMARY OF THE INVENTION

It has now been found that the use of methanesulfonic acid (MSA) or of salts of methanesulfonic acid in aqueous metal-working formulations is particularly advantageous.

DETAILED DESCRIPTION

MSA is stable in water and completely soluble in all proportions at ambient temperature. MSA is non-corrosive; in aqueous solution, it liberates no $H_2S$. MSA is readily biodegradable (100% decomposition in 28 days), which is environmentally friendly. MSA confers particularly advantageous extreme pressure properties on the lubricant formulations.

The subject of the present invention is therefore a method for working or forming metals in the presence of an aqueous lubricant containing a water-soluble extreme pressure additive, characterized in that this additive is methanesulfonic acid (MSA) or a water-soluble salt of MSA.

The water-soluble MSA salts according to the invention are obtained by neutralizing MSA with a salifying agent. Salts of alkali or alkaline-earth metals are preferred as water-soluble MSA salts according to the invention, but use can also be made of the water-soluble salts obtained from compounds satisfying the general formula:

$$R^1NR^2R^3$$

where the symbols $R^1$, $R^2$ and $R^3$, identical or different, each represent a hydrogen atom, an alkyl, alkenyl or alkylaryl radical with 1 to 22 carbon atoms, or an oxyethylated radical of the form $(CH_2—CH_2—O)_nH$, where n is between 1 and 20.

Among the alkali metal salts, those obtained by neutralizing MSA with caustic soda or caustic potash are preferred.

As non-limiting examples of $R^1NR^2R^3$ compounds, mention may be made of alkanolamines, in particular monoethanolamine, diethanolamine or triethanolamine, ethoxylated amines whereof the preferred compounds are those in which $R^1$ is a radical with 12 to 22 carbon atoms, and $R^2$ and $R^3$ are oxyethyl radicals with 1 to 10 ethylene oxide groups.

The salifying agent is added in stoichiometric proportion with respect to the MSA, in excess with respect to the MSA, or in deficiency with respect to the MSA, depending on the pH desired for the final formulation. Preferably, the molar ratio between the MSA and the salifying agent is between 1:1 and 1:2.

The water-soluble MSA salts according to the invention are perfectly stable in water at ambient temperature and can be used to obtain concentrated or dilute aqueous lubricant formulations which are easily stored without liberating any $H_2S$ and have particularly advantageous extreme pressure properties.

Furthermore, these formulations are not corrosive.

The MSA or water-soluble MSA salts can be in the form of a concentrate that can subsequently be diluted during use, or in the form of a dilute solution. They can be used alone, but in general they are used in a mixture with other common additives of synthetic or semisynthetic fluids for metal working or forming. These additives include bactericides, emulsifiers, lubricity promoters, antiwear additives, antifoams and corrosion inhibitors.

The concentrates contain between 10% and 50% by weight of MSA or of water-soluble MSA salt, and preferably between 15% and 35%.

The MSA or the water-soluble MSA salts according to the invention, the concentrates containing same, and other additives conventionally found in aqueous lubricants for metal working or forming, can be incorporated with the aqueous lubricants commonly employed for metal working or forming, and particularly with the synthetic fluids (true solutions) or semisynthetic fluids (microemulsions), in concentrations between 0.01% and 20% by weight, and preferably between 0.1% and 10% by weight.

The efficiency of the extreme pressure additives according to the invention is evaluated by tests on a 4-ball machine by the 4-ball extreme pressure test according to ASTM Standard D-2783: this test consists in evaluating the extreme pressure capacity of a fluid from the value of the load above which 4 balls are welded together, preventing the rotation of the uppermost ball on the other 3 remaining in the test fluid, according to the following measurement protocol:

100C6 steel balls 12.7 mm in diameter

Speed of rotation of the uppermost ball: 1500 revolutions per minute

Test duration: 10 seconds

Increasing loads.

The load corresponding to the welding of the 4 balls corresponds to the extreme pressure capacity; it must be as high as possible, typically=160 kg.

The anticorrosion power of the extreme pressure additives according to the invention is evaluated by contacting chips of cast iron with the aqueous lubricant to be tested by the following protocol:

2 g of standard cast iron chips (ASTM D4627) are covered with 5 ml of aqueous lubricant to be tested in a petri dish with a filter paper on the bottom.

Contact time: 2 hours at ambient temperature.

The appearance of rust on the filter paper is the indicator of the anticorrosion power; the grading is shown in Table 1:

TABLE 1

| Observation on the filter paper | Anticorrosion power |
|---|---|
| No trace of rust | Good |
| Few traces of rust | Medium |
| Traces of rust | Poor |

The following examples illustrate the invention without limiting it. The percentages indicated are expressed by weight.

EXAMPLES

Example 1

Table 2 shows the composition and extreme pressure performance of the different formulations tested; these are dilute aqueous formulations of MSA or 1:1 water-soluble MSA salts. They contain 5% by weight of water-soluble additive.

These formulations are obtained at ambient temperature in a 300 ml beaker containing 200 ml of double-distilled water. The adequate quantity of pure MSA is slowly added with moderate magnetic stirring. The caustic soda (NaOH), caustic potash (KOH), monoethanolamine (MEA), triethanolamine (TEA) or ethoxylated fatty amine (NORAMOX® C2: monoamine on ethoxylated copra base with 2 moles of ethylene oxide or NORAMOX® O2: monoamine on ethoxylated oleic base with 2 moles of ethylene oxide, manufactured by CECA) is then added in stoichiometric proportions to obtain a 1:1 salt containing 5% by weight of active material. The solutions are all clear, stable and without any particular odor. Each of the compositions was subjected to the 4-ball test with determination of the welding load.

TABLE 2

| | Composition | | | Welding load |
|---|---|---|---|---|
| Formulation | Water (in %) | Additive (in %) | | (in kg) |
| Control | 100 | None | | 80 |
| 1 | 95 | MSA | 5 | 400 |
| 2 | 95 | MSA | 3.53 | 400 |
| | | NaOH | 1.47 | |
| 3 | 95 | MSA | 3.16 | 400 |
| | | KOH | 1.84 | |
| 4 | 95 | MSA | 3.06 | 250 |
| | | MEA | 1.94 | |
| 5 | 95 | MSA | 1.96 | 200 |
| | | TEA | 3.04 | |
| 6 | 95 | MSA | 1.19 | 160 |
| | | Noramox C2 | 3.81 | |
| 7 | 95 | MSA | 1.04 | 160 |
| | | Noramox O2 | 3.96 | |

An examination of the results of the 4-ball test reveals that the lubricant formulations based on MSA or a water-soluble MSA salt according to the invention help to obtain a welding load=160 kg, much higher than the load measured with pure water used as a control. The incorporation of an additive based on MSA or a water-soluble MSA salt according to the invention helps to provide extreme pressure properties to the aqueous formulations used for metal working or forming. The MSA and Na and K salts of MSA help to obtain the highest efficiency.

Example 2

Table 3 shows the extreme pressure performance and corrosion properties of two aqueous lubricants containing a water-soluble MSA salt according to the invention. These compositions are prepared by neutralizing MSA with an excess of caustic soda (NaOH) or monoethanolamine (MEA). The water-soluble salt is in a concentration of 5% by weight in water; the compositions are clear, stable and without any particular odor.

TABLE 3

| Formulation | AMS (in moles) | NaOH (in moles) | MEA (in moles) | Welding load (in kg) | Anticorrosion grade |
|---|---|---|---|---|---|
| 8 | 1 | 1.25 | — | 500 | Good |
| 9 | 1 | — | 2 | 200 | Good |

Compositions 8 and 9 according to the invention help to obtain high welding loads in the 4-ball EP test. They have good corrosion properties.

The invention claimed is:

1. A method for working or forming metals in the presence of an aqueous lubricant wherein the improvement comprises adding a water-soluble extreme pressure additive comprising from about 0.01 to about 20 percent by weight a water-soluble salt of methanesulfonic acid comprising a salt of an alkali or alkaline-earth metal, or of a compound of the formula:

$R^1NR^2R^3$ wherein $R^1$, $R^2$ and $R^3$, are identical or different, each a hydrogen atom, an alkyl, alkenyl or alkylaryl radical with 1 to 22 carbon atoms, or an oxyethylated radical of the form (CH2-CHrO)nH, where n is between 1 and 20 to said aqueous lubricant.

2. The method as claimed in claim 1, wherein said water soluble methanesulfonic acid salt is a sodium or potassium salt.

3. The method as claimed in claim 1, wherein said compound of the formula $R^1NR^2R^3$ is an alkanolamine.

4. The method of claim 3 wherein said alkanolamine is a monoethanolamine, diethanolamine or triethanolamine.

5. The method as claimed in claim 1, wherein said compound of the formula $R^1NR^2R^3$ is an ethoxylated amine in which $R^1$ is a radical with 12 to 22 carbon atoms and $R^2$ and $R^3$ are oxyethylated radicals of the formula $(CH_2—CH_2—O)$ nH with n between 1 and 10.

6. The method of claimed in claim 1 wherein the concentration of water-soluble methanesulfonic acid salt in said aqueous lubricant is between about 0.1% and 10% by weight.

* * * * *